United States Patent [19]

Kinsch

[11] 3,935,036

[45] Jan. 27, 1976

[54] METHOD OF FORMING A DARK, VERY ADHERENT COATING ON A CRT MASK ASSEMBLY

[75] Inventor: Frank Joseph Kinsch, Arlington Heights, Ill.

[73] Assignee: Zenith Radio Corporation, Chicago, Ill.

[22] Filed: Feb. 19, 1974

[21] Appl. No.: 443,564

[52] U.S. Cl. ..... 148/6.16; 148/6.35; 313/402; 313/408

[51] Int. Cl.[2] ..... C23F 7/02

[58] Field of Search..... 148/6.16, 6.35, 6.2; 313/402, 403, 404, 405, 406, 407, 408

[56] References Cited

UNITED STATES PATENTS

| | | | |
|---|---|---|---|
| 2,418,608 | 4/1947 | Thompson et al. | 148/6.16 |
| 2,832,708 | 4/1958 | Karchner | 148/6.16 |
| 3,094,441 | 6/1963 | Curtin et al. | 148/6.16 |

*Primary Examiner*—Ralph S. Kendall
*Assistant Examiner*—Charles R. Wolfe, Jr.

[57] ABSTRACT

An improved, cathode ray tube mask assembly having a dark, adherent coating and a method of forming such a coating. A clean mask assembly is treated with a hot solution of chromic and phosphoric acid to form a preliminary protective coating. The mask assembly is then baked to convert the preliminary protective coating to a final dark, very adherent coating.

6 Claims, 4 Drawing Figures

Fig. 1
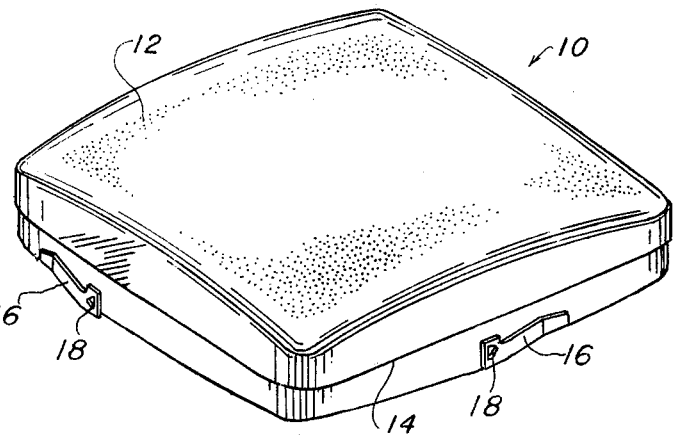
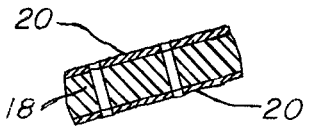
Fig. 2A
Fig. 2
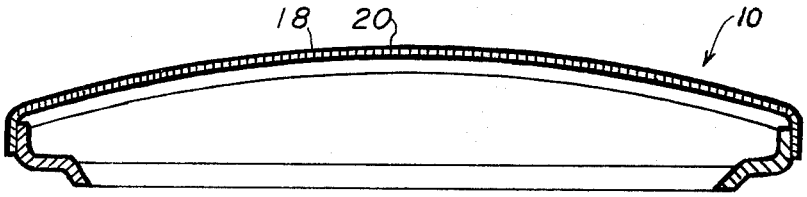
Fig. 3
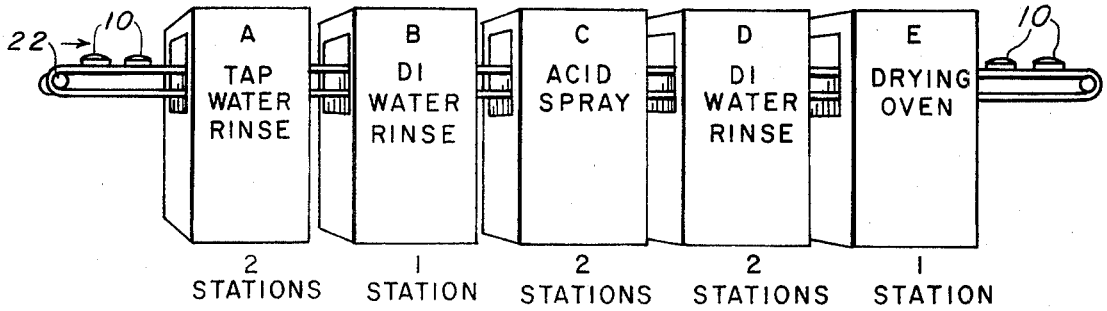

METHOD OF FORMING A DARK, VERY ADHERENT COATING ON A CRT MASK ASSEMBLY

BACKGROUND OF THE INVENTION

A conventional cathode ray tube (CRT) includes a phosphor-coated front panel, a funnel section housing an electron gun for generating one or more electron beams, and a steel color selection electrode (referred to hereinafter as a mask) for exposing selected phosphor elements to the electron beams. The mask is ordinarily welded to a frame which supports it within the front panel and sustains it in a position essentially parallel to the phosphor coated screen. The combination of the mask and its supporting frame, or the mask itself where it is of the type not requiring a separate supporting frame, will be referred to herein as a mask assembly.

In the construction of CRT's, one of the first mask-related operations is to bake the mask assembly in an environment having a low oxygen content and a dew point of approximately 85. By so baking the mask assembly, its surface is given a dark, adherent oxide coating which will protect the mask assembly from corrosion as it and other tube components are processed and assembled in a factory.

It is not unusual for the production line processing of a mask assembly to take 8 hours or more. During this processing interval, flaky oxide deposits can, in the absence of a protective coating, form on the surface of the mask assembly. Such deposits are easily rubbed off and may find their way to the mask apertures where they may lodge and plug some of the apertures.

A dark coating also serves to make the mask assembly a better radiator of heat in order to keep thermal expansion of the mask to a minimum. Although shadow masks are generally provided with some form of thermal compensation to minimize misregistration between mask apertures and the screen's phosphor elements as mask expansion occurs, such compensation is never perfect. Therefore, the better radiator a mask is, the less misregistration will occur as the mask heats up under electron bombardment.

In addition, a dark, preferably black mask will absorb light which finds its way into the tube rather than reflecting it onto the screen where it may tend to dilute or "wash-out" the picture.

For one type of color CRT presently enjoying commercial success, the Chromacolor (trademark of Zenith Radio Corp.) tube, the processing of the tube components proceeds as follows. The inner side of the front panel or screen is coated with a dark, light-absorbing material in which there are patterns of openings in which red, blue and green phosphors will be deposited.

A photoresist coating which includes green phosphors, for example, is then applied over the dark coating. The screen is then exposed to a source of light directed through the mask apertures to render insoluble those areas of the photoresist which occupy the holes in the black coating in which green phosphor is to lie. The screen is then developed to rinse away the green photoresist everywhere except in those areas rendered insoluble by the exposure.

This process is then repeated for the red and blue phosphors so that a pattern of red, blue and green phosphor triads are deposited in the surrounding black material.

The next step involves enlarging each mask aperture so that its dimension in any direction in which misregistration can occur between an electron beam landing and an impinged phosphor element is greater than the corresponding dimension of the impinged phosphor element by a predetermined amount. This will insure that the electron beam which passes through a mask aperture is large enough to cause the electron beam landing to be larger than the phosphor element which it illuminates. This "negative guardband" principle, in combination with the concept of including a light-absorbing material between adjacent phosphor elements, is fully disclosed and claimed in U.S. Pat. No. 3,146,368, issued to Fiore et al, and assigned to the assignee of this invention.

A tried and proven method of enlarging the mask apertures is to re-etch the mask with ferric chloride until a predetermined degree of aperture enlargement has occurred. However, before the etchant can react with the mask, the original protective oxide coating on the mask which has provided corrosion protection during the preceding processing steps must first be removed therefrom. This is usually accomplished by spraying a chemical solution onto the mask assembly to completely strip away the protective coating.

When the re-etch of the mask is complete, the mask assembly will require another protective coating. This coating cannot now be provided in the way the original coating was generated, that is, by baking the mask assembly at a very high temperature. At this point, exposing the mask assembly to the elevated temperatures required to produce such a coating would deform the mask and ruin the registration between the mask and the pattern of phosphor elements on the CRT screen.

Prior art techniques of generating this final coating have included applying chemical solutions such as a standard iron-phosphating solution to the re-etched mask. However, the next processing step, frit sealing the front panel to a mating funnel and baking the assembled tube to cure the frit, tended to adversely affect the mask coating. Since the mask assembly is installed within the tube, it is, of course, subject to the same baking time and temperatures as the curing frit. As a result, the prior art mask assembly coating tended to deteriorate under the intense heat (about 435°C). This caused the mask coating to become flaky and only marginally adherent. The coating could then fall off or be rubbed off the mask assembly and plug some mask apertures or increase the possibilities of arcing within the tube. Accordingly, it is apparent that there is a need for a method of providing an improved coating on CRT mask assemblies, particularly, but not exclusively, for mask assemblies which undergo the above-mentioned re-etch process.

OBJECTS OF THE INVENTION

It is a general object of this invention to provide an improved mask assembly having a dark, adherent coating over its surface, and a method of making the same.

It is another object of this invention to provide a method of forming an improved and more adherent mask coating, especially on shadow mask assemblies which have been re-etched.

PRIOR ART

U.S. Pat. Nos. 2,030,601, 2,245,609, 2,303,242, 2,418,608, 2,494,908, 2,564,864, 2,728,008, 3,074,827, 3,094,441, 3,351,996, 3,404,045, 3,510,366 and 3,604,081.

BRIEF DESCRIPTION OF THE DRAWINGS

The features of this invention which are believed to be novel are set forth with particularity in the appended claims. The invention, together with further objects and advantages thereof, may best be understood, however, by reference to the following description taken in conjunction with the accompanying drawings in which:

FIG. 1 depicts a typical mask assembly to which this invention is applicable;

FIG. 2 depicts a cross-section of the FIG. 1 mask assembly including inner and outer layers of a protective coating on the mask; and FIG. 3 depicts schematically a production line process for treating a mask assembly in accordance with this invention.

FIG. 2A is an expanded view of the circled portion of FIG. 2.

DESCRIPTION OF THE PREFERRED EMBODIMENT

As pointed out in the discussion above, this invention is especially directed toward improving the coating on a CRT mask assembly after the mask has been used to photochemically deposit a pattern of colored phosphor elements on the CRT screen and after the mask apertures have been enlarged by re-etching. A typical CRT mask assembly is shown in FIG. 1. The assembly 10 includes a foraminous shadow mask 12 mounted on a supporting steel frame 14. Three mounting springs 16 are welded to frame 14 and have holes 18 which mate with mounting studs in a front panel (not shown). One mounting stud engages each hole 18 and supports the mask assembly within the front panel.

According to this invention, a protective coating may be formed on a CRT mask assembly by first applying a hot chemical solution over the surface of the mask assembly. The solution preferably has a concentration of about 1% by weight of phosphoric acid ($H_3P_{04}$) and a concentration of about 1/4% by weight of chromic acid ($H_2CR_{04}$), the remainder of the solution being water. The content of the phosphoric acid may, however, be varied over a range of from 0.5% to 2% without severely effecting the efficacy of the solution. It is desirable, however, that the ratio of chromic acid to phosphoric acid be maintained at approximately the same ratio over that range (i.e., approximately 4 to 1). The concentration of phosphoric acid should not be permitted to attain a level much above what has been suggested above. Higher concentrations of phosphoric acid may allow the acid to attack the metal. In some cases where the metal has been so attacked, a green powdery residue, thought to be a combination of chromic phosphate and chromic oxide, formed on the surface of the mask.

The temperature of the solution applied to the mask assembly is preferably within the temperature range of from about 120°F to about 195°F. At this temperature the solution reacts with the surface of the mask assembly at a reasonable rate.

As the acid solution reacts with the steel mask assembly, a silver-gray coating is formed on the surface thereof. This coating is only a preliminary protective coating which will be heat treated to form the final dark coating, all as described below.

The excess of acid is then removed from the mask assembly and the assembly is dried. It is then inserted into its mating front panel and the panel itself is mated with a CRT funnel. A frit cement is applied at the joint between the front panel and the funnel section and the entire assembled tube is then baked. A baking cycle which has been found satisfactory, that is, which both cures the frit cement and which converts the preliminary protective coating on the mask assembly to a final adherent dark coating is as follows: The assembled CRT is brought up to a temperature of 435°C over a period of approximately 40 minutes. When the baking temperature of 435°C is attained, the temperature is maintained at that point for a period of approximately 1 hour. The CRT is then cooled to the ambient temperature over a period of approximately 1 ½ hours.

The result of the entire process is that the mask assembly acquires a dark, adherent coating composed substantially of black iron oxide with a trace of iron chromate and decomposed iron phosphate. See FIG. 2. Mask assembly 10 is coated on both sides by the adherent black oxide coating 20. See FIG. 2A. This coating is not flaky, will not rub off and is sufficiently dark so that the mask assembly acts as a reasonably good radiator of heat. The thickness of the coating and the mask have been exaggerated in FIG. 2 for clarity.

Although the above-described process of forming a mask assembly coating is applicable to all types of shadow masks, it is particularly suited for use with shadow masks which are reetched (as described above) in order to enlarge their apertures. A production line system which has been found to be very suitable for practicing this invention is shown in FIG. 3. As shown, the system includes an automatic conveyor 22 which transports mask assemblies 10 through a series of process stations A through E. In this case, each mask assembly is stepped through a series of eight processing stations, at each of which it remains for approximately 20 seconds.

At stations A, each mask assembly is rinsed with untreated tap water to remove any residual ferric chloride which might remain thereon from the re-etch process. This station is, of course, unnecessary if the mask is not of the type that has been re-etched.

At station B, a mask assembly is given a rinse with deionized water in order to further clean its surface so that the acid spray to follow will react in a way which will result in etching of the mask assembly.

At stations C, the mask assembly is sprayed with a solution of chromic and phosphoric acid having a temperature of approximately 150°F. The concentration of chromic acid is maintained at from about 0.23 to 0.27% by weight while the concentration of phosphoric acid is maintained at from about 0.9 to 1.0% by weight.

At stations D, the mask assemblies are again rinsed with deionized water to remove all traces of the acid spray that have not reacted with the steel of the mask assembly.

Station E is a drying oven which blows heated air onto the mask assembly.

At this point, the mask assemblies are in condition to be inserted into their respective front panels and baked to form the adherent black oxide coating. However, due to manufacturing processing schedules, the acid treated mask assemblies may not be baked for a number of hours. This delay is, however, of no consequence to mask assemblies treated according to this invention since the processing described above in connection with FIG. 3 forms a preliminary protective coating on the assemblies which tends to retard rusting and to passivate the metal.

The mask assemblies 10 exciting from station E are ultimately inserted into their mating front panels. The panels are then frit sealed to a CRT funnel and the entire assembled tube is then baked as described above.

A mask assembly treated in accordance with the directions above will, as set forth in the objects of this invention, produce an improved mask assembly having a dark, adherent coating which is superior to any such coating previously found on re-etched shadow masks. While the invention has been described with specific embodiments thereof, it is evident that many alterations, modifications and variations will be apparent to those skilled in the art in light of the above disclosure. Accordingly, it is intended to embrace all such alterations, modifications and variations which fall within the spirit and scope of this invention as defined by the appended claims.

I claim:

1. A method of forming a dark, adherent coating, primarily of black iron oxide, on a mask assembly having exposed steel surfaces for use in a cathode ray tube bulb, said method comprising:

applying a solution of chromic and phosphoric acid to the exposed steel surfaces of the mask assembly for reaction therewith so as to generate a preliminary protective coating on said exposed surfaces, the ratio of chromic acid to phosphoric acid being approximately 4 to 1 over a range of concentration of phosphoric acid from about 0.5% to 2% by weight;

rinsing the mask assembly to substantially remove therefrom that portion of the acid which did not react with the mask assembly;

inserting the mask assembly into a cathode ray tube bulb; and baking the mask assembly and the bulb so as to convert said preliminary coating to an adherent, dark coating consisting primarily of black iron oxide over the surface of the mask assembly.

2. A method as set forth in claim 1 wherein the temperature of said solution applied to the mask assembly is within the temperature range of from about 120°F to about 195°F.

3. A method as set forth in claim 1 wherein the mask assembly is baked at approximately 435°C for approximately 1 hour.

4. A method of producing a dark, adherent coating, primarily of black iron oxide on a steel cathode ray tube mask assembly which has been re-etched to enlarge its apertures, said method comprising:

spraying the mask assembly with a hot solution of chromic and phosphoric acid, the ratio of chromic acid to phosphoric acid being approximately 4 to 1 over a range of concentration of phosphoric acid from about 0.5% to 2% by weight;

rinsing the excess solution from the mask assembly with a spray of deionized water;

drying the mask assembly;

inserting the mask assembly into its mating front panel;

mating the front panel with a cathode ray tube funnel;

baking the assembled cathode ray tube panel, mask assembly and funnel at approximately 435°C.

5. A method as set forth in claim 4 wherein the temperature of the solution applied to the mask assembly is within the temperature range of from about 120°F to about 195°F.

6. A method as set forth in claim 4 wherein the assembled cathode ray tube is baked by bringing it to a temperature of 460°C over a period of approximately 40 minutes, holding the temperature at approximately 435°C for a period of approximately 1 hour, and cooling the cathode ray tube to the ambient temperature over a period of approximately 1 ½ hours.

* * * * *